US005419162A

United States Patent [19]

Gaiardo

[11] Patent Number: 5,419,162

[45] Date of Patent: May 30, 1995

[54] HIGH SPEED ELECTROMAGNET SELECTION DEVICE FOR SELECTING THE NEEDLES IN A KNITTING MACHINE

[75] Inventor: Mario Gaiardo, Ivrea, Italy

[73] Assignee: Matrix, S.r.l., Ivrea, Italy

[21] Appl. No.: 186,293

[22] Filed: Jan. 25, 1994

[51] Int. Cl.[6] ..... D04B 15/78

[52] U.S. Cl. ..... 66/221; 66/219

[58] Field of Search ..... 66/219–222

[56] References Cited

U.S. PATENT DOCUMENTS

| | | | |
|---|---|---|---|
| 3,896,639 | 7/1975 | Christiansen et al. . | |
| 3,908,403 | 9/1975 | Ringrose | 66/221 |
| 3,998,073 | 12/1976 | Luth | 66/221 |
| 4,471,636 | 9/1984 | Lonati | 66/221 |
| 4,790,154 | 12/1988 | Lonati | 66/221 |
| 4,838,049 | 6/1989 | Lonati | 66/221 X |
| 4,856,300 | 8/1989 | Lonati | 66/221 |
| 5,095,721 | 3/1992 | Negri | 66/221 |

FOREIGN PATENT DOCUMENTS

| | | | |
|---|---|---|---|
| 0219029 | 4/1987 | European Pat. Off. . | |
| 1436607 | 5/1976 | United Kingdom . | |
| 1464750 | 2/1977 | United Kingdom . | |
| 1481146 | 7/1977 | United Kingdom . | |
| 2156390 | 10/1985 | United Kingdom . | |
| 2177126 | 1/1987 | United Kingdom . | |
| 2213503 | 8/1989 | United Kingdom | 66/221 |

*Primary Examiner*—John J. Calvert

*Attorney, Agent, or Firm*—Omri M. Behr; Matthew J. McDonald

[57] ABSTRACT

The device comprises, for each selector element, a high-speed electromagnet having a fixed core with a single coil, and an armature consisting of a lightweight blade. When the coil is energized, the blade is moved into one position, and is restored to another position by means of a compression spring when the coil is de-energized, with a response time of less than 4 ms. The electromagnets are housed in the support of a selection assembly, and packed in at least two offset rows. Each coil is energized at a first voltage and is subsequently maintained energized at a lower voltage.

11 Claims, 5 Drawing Sheets

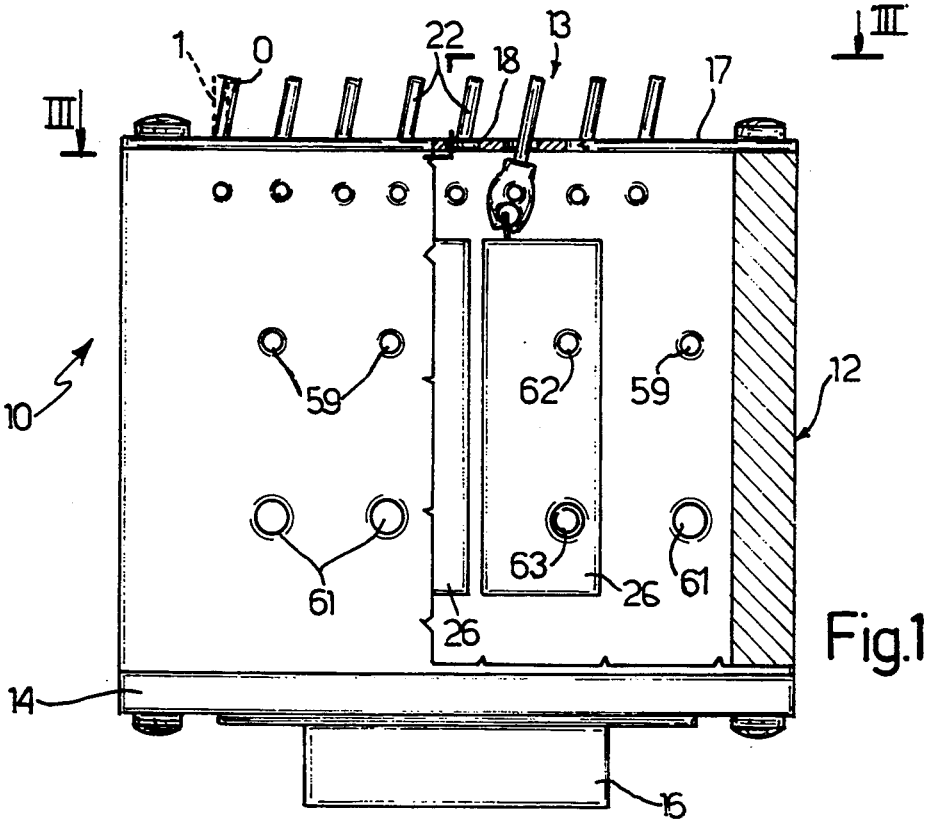
Fig.1
Fig.2
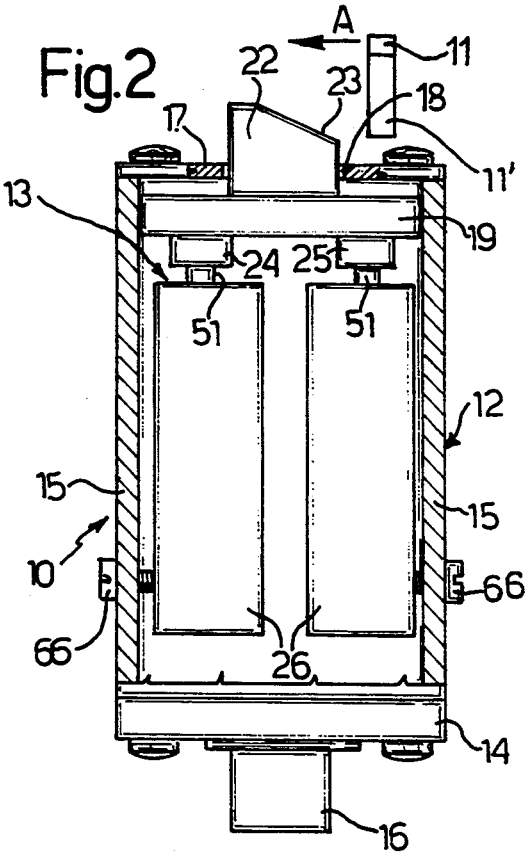
Fig.3
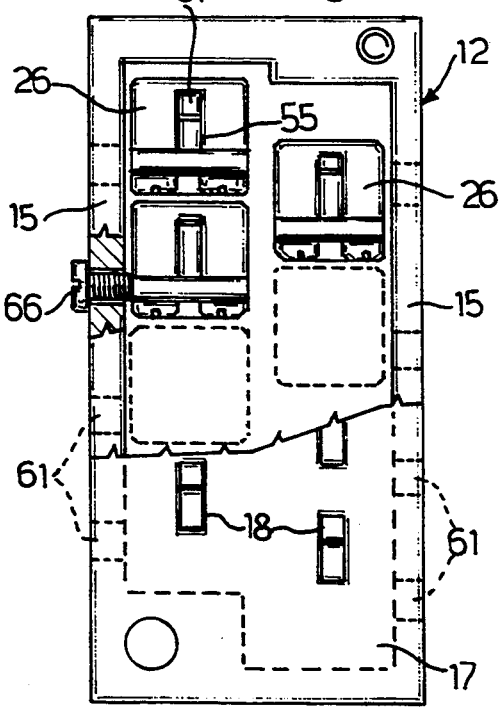

HIGH SPEED ELECTROMAGNET SELECTION DEVICE FOR SELECTING THE NEEDLES IN A KNITTING MACHINE

BACKGROUND OF THE INVENTION

The present invention relates to a needle selecting device for knitting machines or similar.

Knitting or stocking machines normally comprise a number of parallel needles arranged in the form of a cylinder and fitted to a support moving back and forth parallel to the needles. Depending on the pattern of the garment or stocking, at each operating cycle of the support, each needle is so selected as to accompany or not the movement of the support.

For this purpose, each needle is provided with a selector element having a cam portion engaged by the respective needle. The selector element is movable between two selection positions, in one of which the cam portion is positioned along the path of the respective needle; and, for enabling easy assembly on to the machine, selection assemblies are normally provided, each comprising a given number of selector elements.

Selection assemblies are known wherein each selector element is activated by a respective bistable electromagnet, e.g. with a movable core, which is moved to one or other of the two selection positions by a corresponding current pulse. The electromagnets normally present a response time in the region of 8–10 ms, which is far too slow and hence limits the output capacity of the machine.

To speed up operation of the machine, air-powered selection assemblies have been proposed which, despite providing for a response time of about 4 ms, are still relatively slow and, what more, invariably unreliable.

SUMMARY OF THE INVENTION

It is an object of the present invention to provide a straightforward, highly reliable selecting device of the aforementioned type designed to minimize the response time of the selector elements.

According to the present invention, there is provided a needle selecting device for knitting machines or similar, comprising at least one selector element movable between two different positions for selecting a corresponding needle; and an electromagnet for controlling displacement of said element between said positions; characterized by the fact that said electromagnet is a high-speed type, and is energized for moving said element from a first of said positions to the other; elastic means being provided for rapidly restoring said element to said first position when said electromagnet is de-energized.

BRIEF DESCRIPTION OF THE DRAWINGS

A preferred, non-limiting embodiment of the present invention will be described by way of example with reference to the accompanying drawings, in which:

FIG. 1 shows a partially sectioned front view of a needle selecting device in accordance with the present invention;

FIG. 2 shows a partially sectioned side view of the FIG. 1 device;

FIG. 3 shows a partial section along line III—III in FIG. 1;

DETAILED DESCRIPTION OF THE INVENTION

Figure 4:
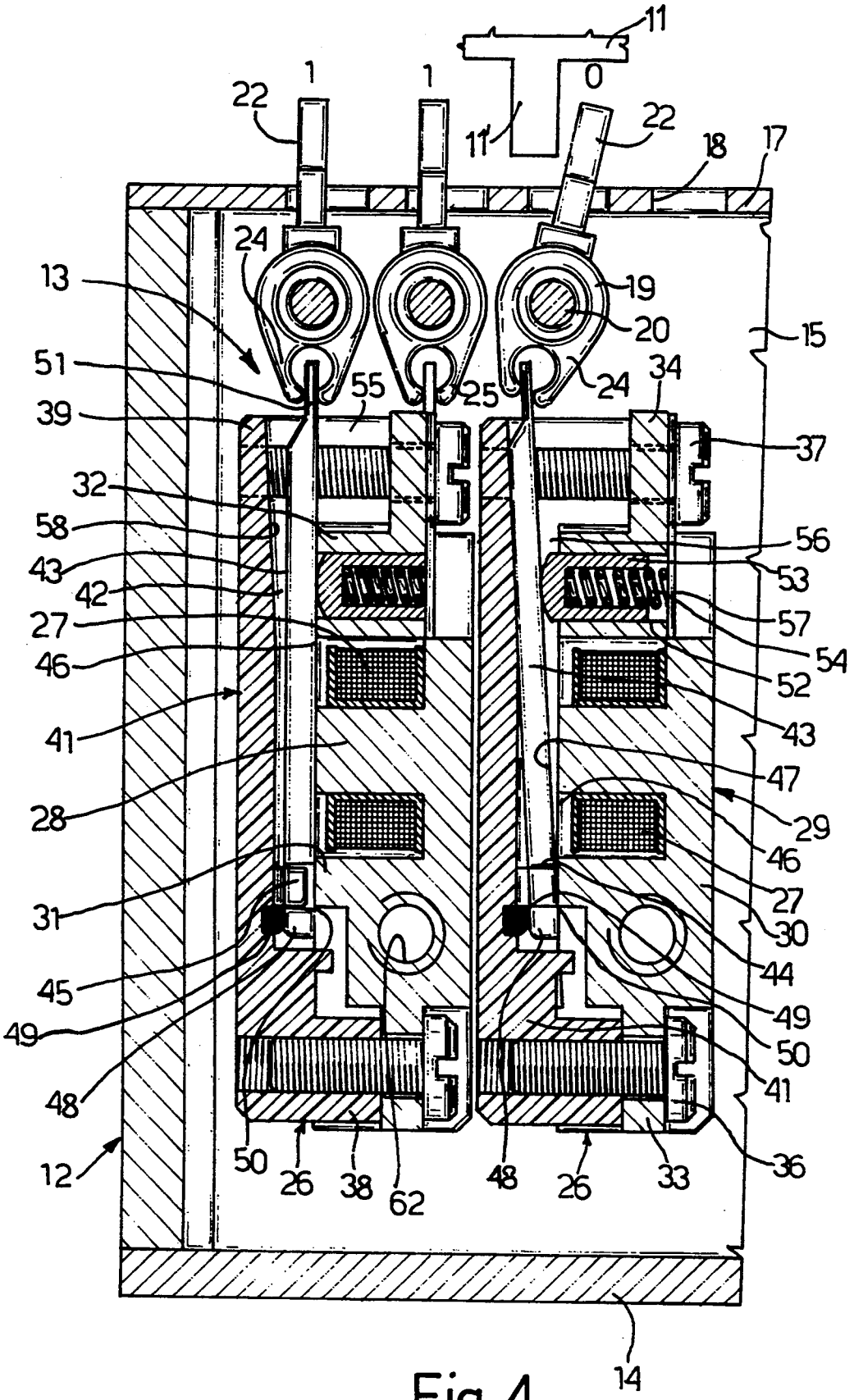
FIG. 4 shows a larger-scale vertical section of a detail in FIG. 1.

Number 10 in FIGS. 1 and 2 indicates a selection assembly for selecting knitting machine needles 11 arranged in the form of a cylinder and fitted to a support (not shown) moving in the direction of arrow A.

Assembly 10 comprises a hollow prismatic support 12 in turn comprising two large parallel walls 15 and housing a series of selection actuators 13. Support 12 is closed at the bottom by a bottom plate 14 fitted with an electric connector 16 for controlling actuators 13, and at the top by a top plate 17 with an opening 18 for each actuator 13. In the example shown, plate 17 presents eight openings 18, and assembly 10 eight selection actuators 13.

Each actuator 13 (FIGS. 4 and 5) comprises a cylindrical bar 19, e.g. made of plastic material, rotating on a shaft 20 fitted to the two walls 15 of support 12. Bar 19 presents an insert in the form of a wear-resistant metal plate 22 projecting radially from bar 19 and having a cam profile 23, e.g. an inclined surface, with which a rectangular-section appendix 11' of respective needle 11 may cooperate. Bar 19 also presents, at two different axial locations, two fork-shaped appendixes 24 and 25 projecting radially from bar 19 in the opposite angular position to plate 22.

Figure 5:
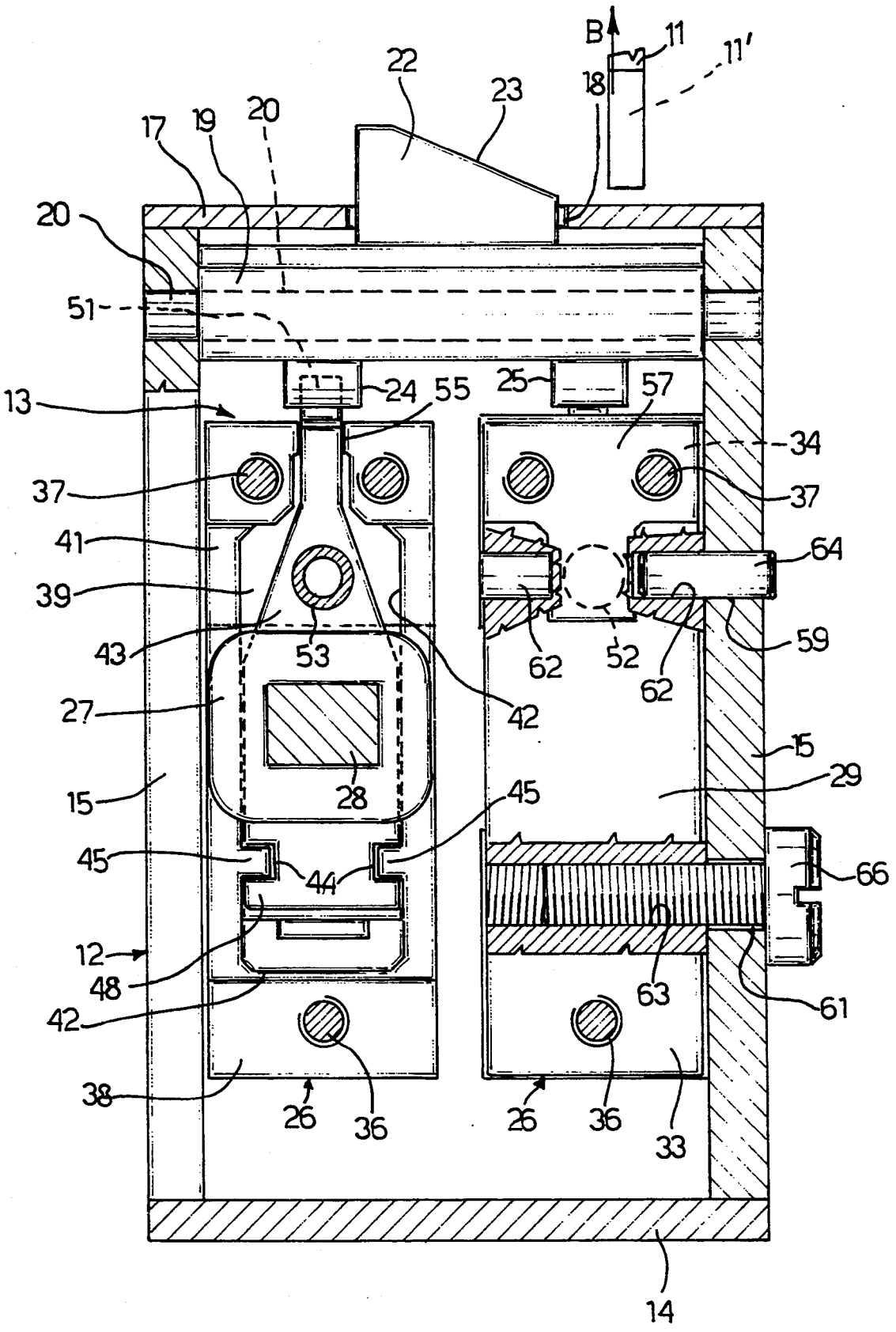
FIG. 5 shows a larger-scale partial vertical section of FIG. 2.

Bar 19 rotates about its longitudinal axis between two selection positions indicated 0 and 1 in FIG. 4. In position 0, plate 22 is positioned clear of the path of appendix 11' of needle 11 so that, when needle 11 is moved leftwards in FIG. 5, appendix 11' is unaffected by plate 22 and hence needle 11 left idle. Conversely, when bar 19 is set to position 1 and needle 11 moved leftwards in FIG. 5, needle 11 is selected, i.e. moved axially by profile 23 in the direction of arrow B.

Each actuator 13 also comprises an electromagnet 26 in turn comprising an electric coil 27 wound about a core 28 of magnetic material via the interposition of an insulating layer. Core 28 is substantially parallelepiped, and is included in a fixed block 29 of magnetic material having a cross piece 30 and two appendixes 31 and 32, extending parallel to core 28, which complete the magnetic circuit of electromagnet 26.

Block 29 also presents two other appendixes or projections 33 and 34 parallel to cross piece 30 and connected by screws 36 and 37 to respective appendixes 38 and 39 of a block 41 of plastic material. Block 41 forms a cover plate for electromagnet 26 which, externally, is thus in the form of a very narrow parallelepipedon enabling troublefree packing as described later on.

Block 41 presents a cavity 42 for guiding and housing the armature, in the form of a flat lightweight blade 43, of electromagnet 26. Blade 43 presents two recesses 44 by which it engages two appendixes 45 of block 41; and an intermediate portion 47 for engaging core 28. The flat surface of core 28 and of appendixes 31 and 32 of block 29 is covered with a sheet 46 of flexible nonmagnetic material such as Mylar or Kapton (registered trade marks).

Blade 43 presents a straight edge 48 engaged by a bar 49 of elastomeric material housed inside a groove in block 41; and rotates, with edge 48, about a stationary rectilinear edge 50 of appendix 31 perpendicular to the axis of core 28. Blade 43 thus moves in a plane perpendicular parallel to said axis. At the opposite end to edge 48, blade 43 also presents a tab 51 projecting from block 41 through an opening 55 and engaging in articulated manner one of fork-shaped appendixes 24, 25 of bar 19.

Appendix 32 of block 29 of the magnetic circuit presents a hole 52 in which slides a hollow cylindrical push rod 53 housing a spiral compression spring 54 for pushing rod 53 into engagement with blade 43 at portion 56 between portion 47 and tab 51. Hole 52 is closed by a metal plate 57 fitted by means of screws 37 to appendix 34 of block 29.

When coil 27 is energized, blade 43 is attracted by core 28, central portion 47 of blade 43 is brought to rest, through sheet 46, against core 28, and the respective bar 19 is moved into position 1, thus compressing the bar 49. Conversely, when coil 27 is de-energized, spring 54, assisted by the elastic action of compressed bar 49, rotates blade 43 about edge 50; detachment of blade 43 from core 28 is assisted by nonmagnetic sheet 46; and blade 43 is brought rapidly to rest against the inclined surface 58 of cavity 42, thus moving bar 19 into position 0.

Electromagnet 26 provides for operating bar 19 at high speed, with a response time of decidedly less than 4 ms, and may advantageously be designed to achieve a response time of 0.5 to 2 ms. For this purpose, the flat lightweight design of blade 43 provides for operating bar 19 with very little effort; and the location of tab 51, on the opposite end of blade 43 to the axis of rotation 50, provides for moving bar 19 with a lever arm greater than that of the forces applied by coil 27 and spring 54.

As already stated, electromagnets 26 are so formed as to enable troublefree packing, for which purpose, for each electromagnet 26, one of walls 15 of hollow support 12 presents a pair of holes 59, 61 of different diameters; and block 29 presents two corresponding holes 62, 63, the latter of which is threaded. Each electromagnet 26 is fitted to said wall 15 of support 12 by means of a locating pin 64 which fits inside holes 59 and 62, and by means of a screw 66 which, through hole 61, screws inside threaded hole 63.

As is known, knitting machines employ a large number of closely spaced needles 11 about 5 mm apart, so that bars 19 (FIGS. 1–3) must also present the same spacing. To enable all of bars 19 to be operated by respective electromagnets 26, these are arranged on support 12 in two rows offset by the distance between bars 19.

For this purpose, the two opposite walls 15 of support 12 present pairs of holes 59, 61 spaced said distance apart; and block 29 presents two coaxial dead holes 62, whereas 63 is a through hole, so that each electromagnet 26 may be fitted indifferently to either one of walls 15 of support 12.

The distance between walls 15 of support 12 corresponds with that between the two fork-shaped appendixes 24 and 25 of bar 19, so that tabs 51 of blades 43 in one row of electromagnets 26 engage appendix 24, while those in the other row engage appendix 25.

Figure 6:
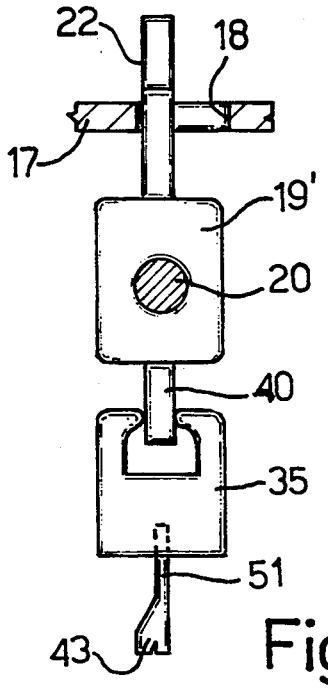
FIG. 6 shows a detail of a section similar to FIG. 4, according to a variation of the present invention.

According to the FIG. 6 variation, cam plate 22 is fitted to a prismatic metal bar 19' rotating on shaft 20; and tab 51 of blade 43 is co-molded with a fork 35 of plastic material engaged by a tab 40 integral with bar 19'. Tab 40 is so fitted to bar 19' as to be radial in relation to shaft 20 in one of the two axial positions, and so enable offset assembly of the two rows of electromagnets 26.

Figure 7:
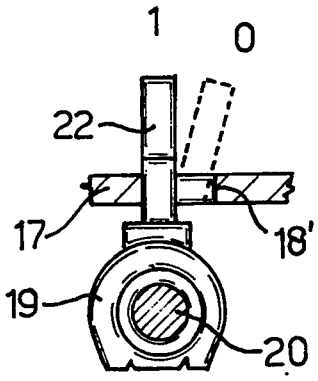
FIG. 7 shows a detail of a section similar to FIG. 4, according to a further variation of the present invention.

According to the FIG. 7 variation, openings 18' in top plate 17 are so sized as to define in themselves the 0 and 1 positions of cam plate 22 in FIG. 4 or 6, so that, when electromagnet 26 (FIG. 4) is energized, blade 43 is no longer arrested against sheet 46 of core 28; and, when electromagnet 26 is de-energized, blade 43 is no longer arrested against surface 58 of block 41.

According to a further characteristic of the present invention, coil 27 of each electromagnet 26 is energized each time with a given voltage and for a given time sufficient to move blade 43 and bar 19, 19' from the 0 to the 1 position; and is subsequently maintained energized with a lower voltage as compared with the above operating voltage, for keeping blade 43 and bar 19 in position 1.

Figure 8:
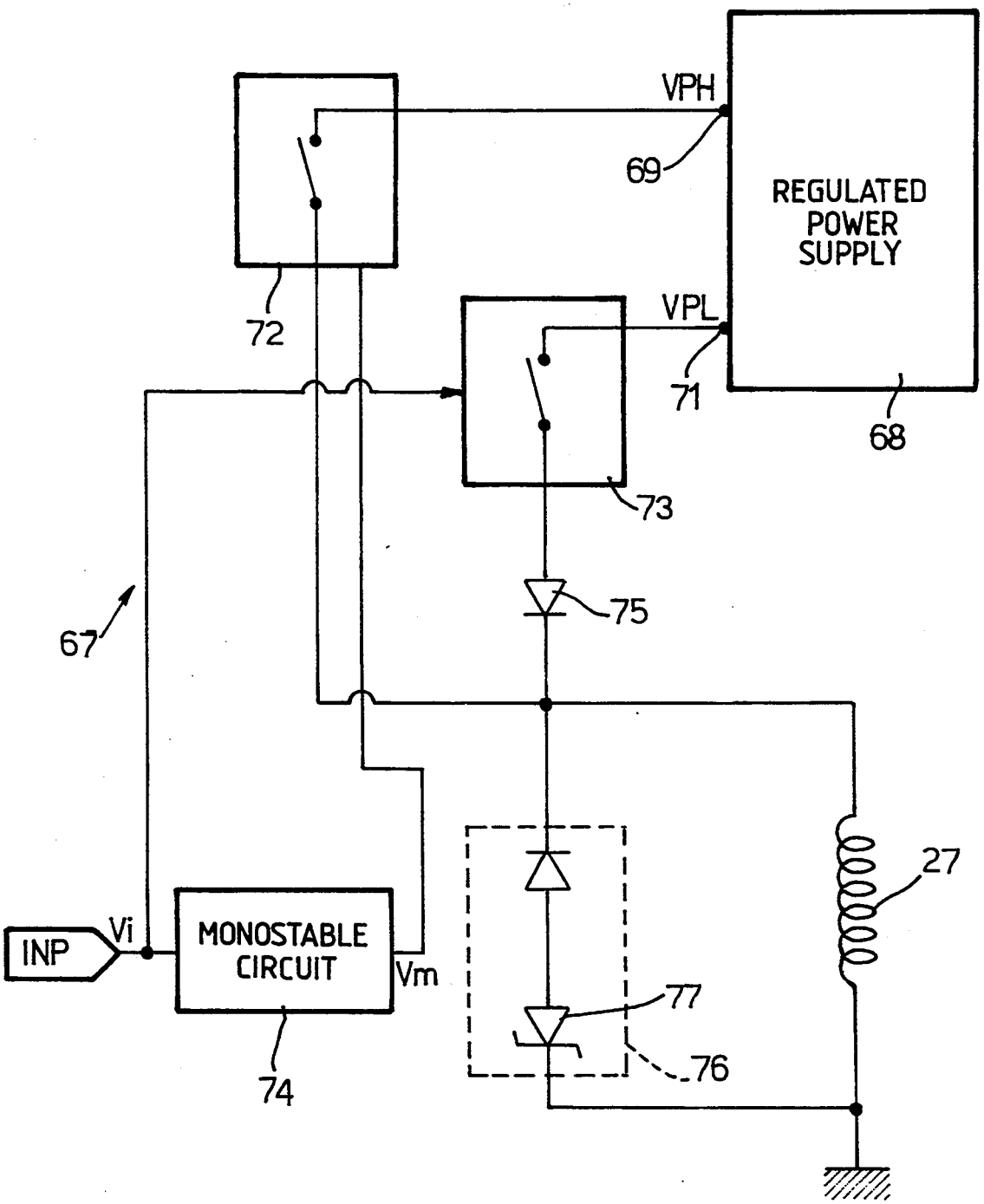
FIG. 8 shows a partial block diagram of the control unit of the device.

For this purpose, each coil 27 is energized by an electronic unit 67 (FIG. 8) connected to a regulated power supply 68 for supplying a first energizing voltage VPH, e.g. 24 V, at a first terminal 69, and a second hold voltage VPL of 5 V, i.e. about 1/5 of voltage VPH, at a second terminal 71.

Unit 67 also comprises two controlled electronic switches 72 and 73 for respectively connecting coil 27 to terminals 69 and 71. Switch 73 is enabled directly by a signal INP which generates a signal Vi (FIG. 9) of a predetermined length corresponding to the total energizing time of coil 27 (FIG. 8), and simultaneously enables a delay circuit consisting of a known monostable integrated circuit 74.

During the period in which circuit 74 is enabled, the output signal Vm from circuit 74 enables switch 72 which is thus enabled simultaneously with switch 73; and a diode 75 prevents the VPH voltage supplied by switch 72 from affecting switch 73. Circuit 74 may advantageously be so selected as to supply output signal Vm (FIG. 9) for a time ranging from 1 to 2 ms, and advantageously of 1.5 ms.

Figure 9:
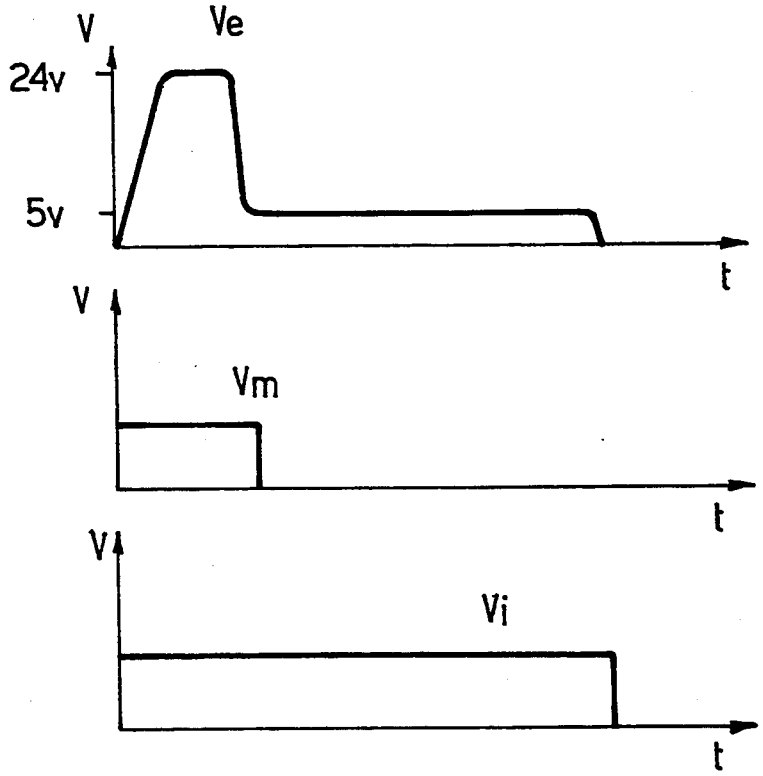
FIG. 9 shows three device control graphs.

FIG. 9 also shows a graph of the energizing voltage Ve of coil 27 in relation to time. Unit 67 (FIG. 8) also comprises a current cutout circuit 76 including a Zener diode 77 for preventing sparking when coil 27 is de-energized.

The advantages of the selection device according to the present invention will be clear from the foregoing description. In particular, it provides for high-speed operation by an electromagnet 26 activated by constant-sign current, and for high-density packing of electromagnets 26 which may all be the same. Finally, unit 67 provides for maintaining coils 27 energized at very low voltage, thus reducing heating of the device.

To those skilled in the art it will be clear that changes may be made to the device as described and illustrated herein without, however, departing from the scope of the present invention. For example, changes may be made to the number and spacing of selection bars 19, 19' which may respectively present three or more fork-shaped appendixes 24, 25 and tabs 40; and, accordingly, electromagnets 26 may be arranged in three or more rows for further reducing the spacing of actuators 13.

Moreover, changes may be made to magnetic circuit 29 and/or blade 43; blade 43 may be fitted to or in one piece with selection plate 22; and changes may be made to the components of electronic unit 67 for energizing coils 27, to the energizing time of circuit 74, and to the energizing voltages of coils 27.

I claim:

1. A high speed electromagnet selection device for selecting the needles in a knitting machine, comprising at least one selector element pivotally movable between two different angular positions for selecting a corresponding needle; an electromagnet energizable for moving said selector element from a first one of said angular positions to the other one of said angular positions, said electromagnet including a fixed core of ferromagnetic material having a predetermined axis; an armature movable in a plane parallel to said axis and provided with a tab connected to said selector element; and elastic means acting on said armature for rapidly restoring said selector element to said first angular position when said electromagnet is de-energized; wherein said armature is formed of a blade having a straight edge portion opposite to said tab, said blade pivoting about a stationary rectilinear edge adjacent to said edge portion; said elastic means including a spring engaging said blade, and a bar of elastomeric material engaging said edge portion, said bar being elastically deformable by said edge portion when said electromagnet is energized, so as to assist said spring in restoring said blade to said first angular position.

2. A device as claimed in claim 1, wherein said core (28) is engaged by an intermediate portion (47) of said blade (43) located between said edge (48) and said tab (51); said a spring (54) acting on a second portion (56) located between said intermediate portion (47) and said tab (51).

3. A device as claimed in claim 2, wherein said spring (54) is a helical compression spring housed inside a hollow push rod (53); said rod (53) being adapted to slide axially into a guide hole for acting on said second portion (56).

4. A device as claimed in claim 2, characterized by the fact that, between said core (28) and said blade (43), there is provided a sheet (46) of nonmagnetic material for assisting detachment of said blade (43) from said core (28) when said electromagnet (26) is de-energized.

5. A device as claimed in claim 2, wherein said core is substantially parallelepiped and is included in a fixed block of ferromagnetic material, said block having a cross piece and two appendixes extending parallel to the axis of said core and adapted to be engaged by said blade, said rectilinear edge being provided on one of said appendixes, said spring being housed in a guide hole provided on the other one of said appendixes.

6. A device as claimed in claim 5, wherein said block also includes a pair of other projections parallel to said cross piece, a cover plate of non magnetic material provided with a cavity for movably housing said blade, and at least two screws connecting said cover plate to said projections as to a form with said block a parallelepipedon, at least one of said screws also connecting to said block a metal plate closing said guide hole.

7. A device as claimed in claim 6, wherein said block is provided with a reference hole and with a threaded hole, said reference hole and said threaded hole being perpendicular to the axis of said core, said block being removably mounted on a support plate having a hole corresponding to said reference hole for fitting a reference pin, said support plate having another hole corresponding to said threaded hole for fitting a single connecting screw.

8. A device as claimed in claim 6, comprising a number of selector elements adapted to be individually controlled by a corresponding number of electromagnets, and a single container having a pair of parallel support plates for removably mounting said electromagnets in a corresponding pair of rows wherein each said block is provided with a pair of coaxial reference dead holes and with a single threaded through hole, said reference holes and said threaded hole being perpendicular to the axis of each said core, each one of said support plates having a number of holes each one corresponding to said reference holes of each said block for fitting a corresponding reference pin, said support plates having a number of other holes corresponding to said threaded hole in each said block for fitting a corresponding single connecting screw, whereby each one of said electromagnets can be connected to either of said plates.

9. A high speed electromagnet selection device for selecting the needles in a knitting machine, comprising at least one selector element pivotally movable between two different angular positions for selecting a corresponding needle; an electromagnet energizable for moving said selector element from a first one of said angular positions to the other one of said angular positions; and elastic means acting on said armature for rapidly restoring said selector element to said first angular position when said electromagnet is de-energized; wherein said electromagnet comprises a single coil which is energized by an energizing unit comprising a delay circuit, said energizing unit firstly energizing said coil at a first voltage for moving said selector element from said first angular position to said other angular position, and being conditioned by said delay circuit after a predetermined time for energizing said coil at a second voltage lower than said first voltage for keeping said selector element in said other angular position.

10. A device as claimed in claim 9, wherein said energizing unit is of the electronic type and is connected to a power supply (68) for supplying said voltages; said electronic unit (67) comprising a control circuit (73) for directly selecting said lower voltage and wherein said delay circuit (74) is simultaneously with said control circuit (73), for enabling a second control circuit (72) and substituting said lower voltage with said first voltage.

11. A device as claimed in claim 10, wherein said delay circuit comprises a monostable integrated circuit (74) for controlling said substitution for 1 to 2 ms; said lower voltage being roughly 1/5 of said first voltage.

* * * * *